US006635607B2

(12) United States Patent
Queen et al.

(10) Patent No.: US 6,635,607 B2
(45) Date of Patent: Oct. 21, 2003

(54) MIXED POLYALKYLENE GLYCOL HYDROXYALKYL ISOSTEARAMIDES AS RHEOLOGY ADJUVANTS

(75) Inventors: Craig B. Queen, Middletown, DE (US); John L. Gormley, Midland Park, NJ (US)

(73) Assignee: ICI Americas Inc., Bridgewater, NJ (US)

( * ) Notice: Subject to any disclaimer, the term of this patent is extended or adjusted under 35 U.S.C. 154(b) by 261 days.

(21) Appl. No.: 09/855,826

(22) Filed: May 15, 2001

(65) Prior Publication Data

US 2003/0036498 A1 Feb. 20, 2003

(51) Int. Cl.[7] ..... C11D 1/14; C11D 1/75; C11D 1/83; C11D 3/32

(52) U.S. Cl. ..... 510/124; 510/123; 510/125; 510/126; 510/127; 510/130; 510/137; 510/138; 510/158; 510/159; 510/501; 510/502; 510/506

(58) Field of Search ..... 510/123, 124, 510/125, 126, 127, 130, 137, 138, 158, 159, 501, 506, 502

(56) References Cited

U.S. PATENT DOCUMENTS

| | | | | |
|---|---|---|---|---|
| 2,991,296 A | | 7/1961 | Scherr | |
| 3,882,038 A | | 5/1975 | Clayton et al. | 252/164 |
| 6,034,257 A | | 3/2000 | Oftring et al. | |
| 6,200,554 B1 | | 3/2001 | Yeoh et al. | 424/70.12 |
| 6,514,918 B1 | * | 2/2003 | Librizzi | 510/124 |
| 6,531,443 B2 | * | 3/2003 | Perella et al. | 510/501 |
| 2002/0173435 A1 | * | 11/2002 | Librizzi | 510/130 |

FOREIGN PATENT DOCUMENTS

| | | |
|---|---|---|
| CA | 1 153 510 | 9/1983 |
| DE | 196 50 151 | 6/1998 |
| EP | 23 334 | 2/1981 |
| EP | 1 179 335 | 2/2002 |
| GB | 783778 | 10/1957 |
| GB | 962585 | 7/1964 |
| JP | 8 337 560 A | 12/1996 |
| WO | WO 99/46356 | 9/1999 |

OTHER PUBLICATIONS

U.S. patent application No. 09/793,042 filed, Feb. 26, 2001.
U.S. patent application No. 09/334,812 filed, Jun. 17, 1999.
U.S. patent application No. 09/038,736 filed,Mar. 11, 1998.

* cited by examiner

*Primary Examiner*—Gregory Delcotto
(74) *Attorney, Agent, or Firm*—Polly E. Ramstad

(57) ABSTRACT

Adjuvant surfactant compositions for beneficially modifying the properties, particularly rheological properties, of surfactant systems are provided. The surfactant compositions, which include at least one primary surfactant and can be substantially free of monoethanolamines, diethanolamines, and diethanolamides include alkoxylated hydroxyalkyl isostearamide which is substantially a liquid at room temperature. The isostearamide composition may also include a second surfactant. Methods of preparation and uses are also disclosed.

46 Claims, No Drawings

MIXED POLYALKYLENE GLYCOL HYDROXYALKYL ISOSTEARAMIDES AS RHEOLOGY ADJUVANTS

FIELD OF THE INVENTION

The present invention relates to alkoxylated alkanolisostearamides useful as adjuvants to modify the rheological properties of surfactant systems. More specifically, the invention relates to polypropylene glycol hydroxyethyl isostearamide compositions and methods of use to provide unanticipated and exceptional increases in viscosity, especially when used as the sole thickener for a surfactant system.

BACKGROUND OF THE RELATED TECHNOLOGY

Surfactants may be combined in a cleansing system to alter the properties and/or esthetic qualities of the system including rheology. Rheology is the study of how materials deform and flow under the influence of external forces. Viscosity, which is the measure of resistance to flow, is one aspect of the scientific discipline of rheology. One area in which rheological properties are important is related to liquid cleansers and personal care products. The rheological properties of liquid cleansers, such as shampoos, liquid hand cleansers, and industrial cleansers, are a key element of their acceptability in the marketplace. A consumer will purchase these products based on their esthetics or perceived qualities. Even though a product may be otherwise functional, a consumer will often not repurchase a product, if there is the slightest degradation of esthetics compared to the expected profile which includes the thickness and feel of the product.

Desirable properties of surfactants include the ability to increase viscosity (or thicken), maintain color stability, and provide foam boosting and stabilization. Monoethanolamides and diethanolamides are commonly known to provide these characteristics. These are typically added to a cleansing system that includes a primary surfactant which may be cationic, anionic, nonionic, or amphoteric. Surfactants that are frequently used as the primary surfactant in personal care and industrial cleanser products include sodium lauryl sulfate (SLS), sodium laureth sulfate (SLES), ammonium lauryl sulfate (ALS), ammonium lauryl ether sulfate (ALES), alpha olefin sulfonates (AOS) such as 2-alkene sulfonate, 3-hydroxyalkene sulfonate, 4-hydroxyalkene sulfonate, secondary $C_{14-17}$ alkane sulfonates (SAS), amine oxides, cocoamidopropyl betaine (CAB), and combinations thereof. Both diethanolamides and monoethanolamides, as will be discussed later herein, have disadvantages associated with their use.

Surfactant compositions, particularly anionic and cationic ones, will frequently include an addition of sodium chloride or other salts to modulate the viscosity of a liquid cleansing system. Typical cleansing systems use between 0.05% and 3% by weight or more salt to control the viscosity to a desired level. SLS and SLES are two commonly employed surfactants that can be thickened with only nonionic surfactants and salt. Economically, it is highly desirable to achieve a rich, thickened formulation with only a minimum amount of surfactants, since water and salt are very inexpensive.

Branched surfactant materials are usually much more difficult to thicken than straight chain counterparts. An example of this is $C_{14-16}$ alpha olefin sulfonates, a mixed anionic surfactant which contains a portion of hydroxy branching and another example is secondary ($C_{14}$–$C_{17}$) alkane sulfonates (SAS). The materials are significantly harder to thicken in a traditional manner (using non-ionic surfactants and salt) as compared to the predominantly linear SLS or SLES type surfactants.

Typically, liquid alkyl diethanolamide (DEA) surfactants have been used as foam boosters and thickeners in liquid cleansing systems. One of the most favorable attributes of diethanolamides is their liquidity at room temperature. This allows cleansing products to be manufactured without the additional step of heating the production batch thereby saving the cost of providing the heat energy needed. However, diethanolamides have unfavorable characteristics and are frequently associated with diethanolamines, which can react with nitrogen oxides and sodium nitrite to form nitrosamines, which are known to be carcinogenic. Consequently, diethanolamides are poor choice for inclusion in future surfactant formulations due to possible regulatory considerations.

Cocamide MEA (monoethanolamide) is also known to provide the desired thickening properties. However, monoethanolamides, including cocamide MEA, are not generally a liquid at room temperature and therefore require an additional heating step. Furthermore, it is difficult to incorporate fragrances in monoethanolamides due to their solid state at room temperature. The more desirable method of incorporating a fragrance into a surfactant system, which will include water, is to mix the fragrance with a liquid surfactant first, because the fragrances are frequently oil-soluble and not water soluble.

Individual alkoxylated alkanolamide surfactants for cleansing systems and methods of preparation have been disclosed in a U.S. application Ser. No. 09/793,042, filed Feb. 26, 2001, a continuation of U.S. application Ser. No. 09/334,812 filed Jun. 17, 1999, now abandoned, which is a continuation in part of U.S. application Ser. No. 09/038,736 filed Mar. 11, 1998, all of which are hereby incorporated by reference. These alkoxylated alkanolamides may include capryl, stearic, soy oil, and coconut oil fatty monoethanolamides.

While each of these materials have many useful properties, they have potential drawbacks if used individually as the sole thickener. These potential drawbacks include one or more of the following: poor color stability, poor viscosity increasing performance, or poor foam boosting performance as well as incompatibility with some surfactant systems. One example is polypropylene glycol (PPG) hydroxyethyl caprylamide, which provides excellent color stability and is a good foam booster, but has little viscosity building character. Another example is PPG hydroxyethyl cocamide, which is compatible with nearly all surfactant systems and has good color stability, but does not build viscosity very well in comparison to cocamide MEA, from which it is derived. A third example, PPG hydroxyethyl soyamide (a straight chained unsaturated $C_{18}$ derived from soy bean oil) provides viscosity building character, but has poor color stability.

Japanese Laid Open Patent Application No. 8-337560 to Kawaken Fine Chemicals Co., Ltd, also describes propoxylated amides, but does not disclose surfactant compositions that exclude diethanolamides. Furthermore, Kawaken recognizes no difference Consequently, there is a need to provide a surfactant composition that is substantially a liquid at room temperature, and increases viscosity and foam boosting, while providing color stability and desired rheological properties and does not have the potential to create nitrosamines.

Desirably, the surfactant composition may also act as a solubilizer to make added substances soluble in the preparation of either solid or liquid compositions.

SUMMARY OF THE INVENTION

One aspect of the present invention provides a surfactant system that includes a primary surfactant composition and an adjuvant composition that includes poly ($C_2$–$C_4$) alkylene glycol hydroxy ($C_2$–$C_3$) alkyl isostearamide, wherein the adjuvant composition is substantially a liquid at room temperature and modifies the rheological properties of the surfactant system. The adjuvant enables the surfactant system to be formulated without the need for mono- and di-ethanolamines or diethanolamides.

Another aspect of the present invention provides an adjuvant composition for modifying the rheological properties of a surfactant system, wherein the adjuvant composition is substantially liquid at room temperature and includes a first surfactant comprising poly ($C_2$–$C_4$) alkylene glycol hydroxy ($C_2$–$C_4$) alkyl isostearamide and a second surfactant different than the first surfactant.

A further aspect of the present invention provides a method of thickening a surfactant system that includes at least one primary surfactant. The method includes the step of adding to the surfactant system an adjuvant composition that includes poly ($C_2$–$C_4$) alkylene glycol hydroxy ($C_2$–$C_3$) alkyl isostearamide, wherein the adjuvant composition is substantially a liquid at room temperature. The composition may also include a second surfactant.

The present invention also provides a surfactant system that is the reaction product of a primary surfactant composition and an adjuvant surfactant composition that includes poly ($C_2$–$C_4$) alkylene glycol hydroxy ($C_2$–$C_4$) alkyl isostearamide which is substantially a liquid at room temperature and modifies the rheological properties of the surfactant system. Again, in this surfactant system there is no need to have monoethanolamines, diethanolamines, or diethanolamides present.

In addition, the present invention provides a cleansing composition that includes a primary surfactant composition selected from amine oxides, sodium lauryl sulfate, sodium laureth sulfate, ammonium lauryl sulfate, ammonium lauryl ether sulfate, 2-alkene sulfonate, 3-hydroxyalkene sulfonate, 4-hydroxyalkene sulfonate, secondary alkane sulfonates, cocoamidopropyl betaine, and combinations thereof; and an adjuvant surfactant composition to modify rheological properties that is substantially free of monoethanolamines, diethanolamines, and diethanolamides that includes an adjuvant composition that is substantially a liquid at room temperature comprising poly ($C_2$–$C_4$) alkylene glycol hydroxy ($C_2$–$C_4$) alkyl isostearamide and a second surfactant different than the isostearamide selected from the group consisting of polypropylene glycol hydroxyethyl caprylamide, polypropylene glycol hydroxyethyl cocamide, and combinations thereof

DETAILED DESCRIPTION OF THE INVENTION

For purposes of the present invention, the term adjuvant is defined as an additive that modifies the properties of compositions. This includes additives that may modify the rheological properties of a composition, such as a surfactant system.

The present invention provides surfactant adjuvant compositions to modify the rheological properties of a surfactant system without requiring added monoethanolamines, diethanolamines, and diethanolamides. Desirably, the surfactant composition is an alkoxylated alkanolamide or combination of the different alkoxylated alkanolamides that may be added to a surfactant system at room temperature without heating and is compatible with a majority of surfactant systems.

More specifically, the present invention relates to mixed ($C_2$–$C_4$) alkoxylated hydroxy ($C_2$–$C_3$) isostearamides as beneficial adjuvants in surfactant systems. Desirable ($C_2$–$C_4$) alkoxylated portion includes ethoxy, branched propoxy, branched butoxy and combinations thereof. Hydroxy ($C_2$–$C_3$) alkyl means hydroxyethyl, hydroxyisopropyl and combinations thereof, hydroxyethyl is preferred. Thus, the invention includes surfactant systems containing the isostearamide wherein the addition of the isostearamide adjuvant beneficially affects the surfactant systems properties particularly rheology, primarily viscosity but, if desired, also foam stability, foam boosting and solubilization. The surfactant system contains one or more surfactants, referred to as primary surfactants. Additionally, the adjuvant composition may include another surfactant(s) (other than the isostearamide) referred to as the secondary surfactant.

The mixed alkoxylated monoalkanol isostearamide is substantially liquid at about room temperature. This is achieved by alkoxylating monoethanol isostearamide, monoisopropyl isostearamide or combinations thereof with a ($C_2$–$C_4$) alkylene oxide such as ethylene oxide, propylene oxide, butylene oxide and combinations thereof. However, when ethylene oxide is used, care is needed to avoid over alkoxylating to the point of causing crystallization. Preferably a mixture of ethylene and propylene oxides and more preferably propylene oxide. The amount of alkoxylation needs to be sufficient to result in the monoethanol-monoisopropyl- or mixed ethanol and isopropyl-isostearamide becoming substantially liquid at room temperatures. The alkoxylated hydroxyalkyl/isostearamide is the reaction product of isostearic acid and monoethanolamine or monoisopropanol followed by reaction in the presence of a suitable catalyst (for example, potassium hydroxide, sodium alcoholate) with at least about one mole of the alkylene oxide. At less than about a mole of alkylene oxide, the resultant product may not be liquid at room temperature. Generally, from 1 to about 8 moles of alkylene oxide will be used. As a number of moles increases to about 4 and above the resultant hydroxyalkyl isostearamide will begin to act primarily as a solubilizer. For optimal rheology benefits, the amount of alkoxylation will be from about 1 to 5, desirably 1 to 3.

Typically the polyalkylene glycol hydroxyalkyl isostearamide reaction products are written with a subscript number following the alkylene glycol to denote the number of moles of polyalkylene glycol, such as polypropylene $glycol_{1.5}$ hydroxyethyl isostearamide or $PPG_{1.5}$ hydroxyethyl isostearamide, or for mixed systems, $(PEG)_m(PPG)_n$ wherein PPG is polypropylene glycol and PEG is polyethylene glycol. The number of moles will be an average for the isostearamide compositions. The resultant adjuvant will be a mixture of compositions due to the source of the isostearic acid (being a mixture of isomers) and the nature of the alkoxylation process.

The surfactant adjuvant compositions enable one to particularly modify the rheological properties of a surfactant system without the need to use monoethanolamines, diethanolamines, or diethanolamides with the adjuvant.

More specifically, the present invention relates to polypropylene glycol hydroxyethyl isostearamide, including polypropylene glycol (PPG) hydroxyethyl isostearamide compositions, methods of preparation, and methods of use. PPG hydroxyethyl isostearamide has been found to produce unexpected and exceptional qualities as a surfactant to modify the rheological properties of a surfactant system, especially with respect to the ability to increase the viscosity of a surfactant system. This result is accomplished without the addition of monoethanolamines, diethanolamines, and diethanolamides. PPG hydroxyethyl isostearamide is the reaction product of isostearic acid and monoethanolamine followed by at least about one mole of propoxylation.

Another advantage of hydroxyethyl isostearamide adjuvants used in this invention is they are substantially liquid at room temperature. This allows for mixture into a surfactant system without an additional heating step and permits fragrances to be mixed with the isostearamide adjuvant prior to incorporation into a surfactant system. This is an example of the isostearamide adjuvant acting as a solubilizer. The fragrance may be any of a variety of fragrances known to be added. Desirably the isostearamide includes at least about one mole of PPG. The PPG hydroxyethyl isostearamide may be present in a larger percentage, up to or higher than about 20%, particularly when used as part of a detergent concentrate. For economic considerations, the alkoxy hydroxyalkyl isostearamide is desirably present in a small percentage of the surfactant system, desirably up to about 5% by weight of the surfactant system. The upper and lower amounts of the PPG hydroxyethyl isostearamide are governed by the ability of the surfactant system to achieve the desired effects. Generally, the PPG hydroxyethyl isostearamide is present in amounts as low as 0.1% by weight of the surfactant system. The PPG hydroxyethyl isostearamide is most desirably in the range of about 1% to about 3% by weight.

Other beneficial effects of the isostearamide adjuvant include its affect on rheology which includes the ability to thicken a surfactant system. This adjuvant may also beneficially affect foam stabilization or boost the foaming properties of a surfactant system or lower the Krafft temperature.

A large number of applications and final end products are contemplated by the present invention. Therefore, a variety of different surfactants may be used depending on the desired properties of the end product. Among the many products in which the surfactant systems of the present invention may be incorporated include, without limitation, skin care products such as soap, liquid hand cleansers, body washes, facial washes, lotions, moisturizers, sun screens, and make-up; hair care products such as shampoos, conditioners, hair dyes and colorants and hair gels; industrial cleaners, household cleaners as well as pre-moistened towels such as baby wipes and geriatric wipes.

Therefore, the adjuvant composition may be incorporated in a wide variety of surfactant systems that include one or more primary surfactants. Examples of surfactants that may be added to the primary surfactant system or to the adjuvant composition may include anionic, cationic, nonionic, amphoteric or zwitterionic surfactants as described in further detail below.

Primary anionic surfactants include alkyl and alkyl ether sulfates. These materials have the respective formulae $ROSO_3M$ and $RO(C_2H_4O)_xSO_3M$, wherein R is alkyl or alkenyl of from about 8 to about 30 carbon atoms, x is 1 to about 10, and M is hydrogen or a cation such as ammonium, alkanolammonium (e.g., triethanolammonium), a monovalent metal cation (e.g., sodium and potassium), or a polyvalent metal cation (e.g., magnesium and calcium). Desirably, M should be chosen such that the anionic surfactant component is water soluble. The anionic surfactant or surfactants should be chosen such that the Krafft temperature is about 15° C. or less, preferably about 10° C. or less, and more preferably about 0° or less.

Krafft temperature refers to the point at which solubility of an ionic surfactant becomes determined by crystal lattice energy and heat of hydration, and corresponds to a point at which solubility undergoes a sharp, discontinuous increase with increasing temperature. Each type of surfactant will have its own characteristic Krafft temperature. Krafft temperature for ionic surfactants is, in general, well known and understood in the art. A visual indicator of when the Krafft point has been reached is when the solution becomes cloudy as temperature is lowered.

In the alkyl and alkyl ether sulfates described above, desirably R has from about 12 to about 18 carbon atoms in both the alkyl and alkyl ether sulfates. The alkyl ether sulfates are typically made as condensation products of ethylene oxide and monohydric alcohols having from about 8 to about 24 carbon atoms. The alcohols can be derived from fats, e.g., coconut oil, palm oil, tallow, or the like, or the alcohols can be synthetic. Such alcohols are reacted with 1 to about 10, and especially about 3, molar proportions of ethylene oxide and the resulting mixture of molecular species having, for example, an average of 3 moles of ethylene oxide per mole of alcohol, is sulfated and neutralized.

Specific examples of alkyl ether sulfates which can be used in the present invention are sodium and ammonium salts of coconut alkyl triethylene glycol ether sulfate; tallow alkyl triethylene glycol ether sulfate, and tallow alkyl hexaoxyethylene sulfate. Preferred alkyl ether sulfates are those comprising a mixture of individual compounds, said mixture having an average alkyl chain length of from about 12 to about 16 carbon atoms and an average degree of ethoxylation of from 1 to about 4 moles of ethylene oxide. Such a mixture also comprises from 0% to about 20% by weight of $C_{12-13}$ compounds; from about 60% to about 100% by weight of $C._{14-16}$ compounds, from 0% to about 20% by weight of $C_{17-19}$ compounds; from about 3% to about 30% by weight of compounds having a degree of ethoxylation of 0; from about 45% to about 90% by weight of compounds having a degree of ethoxylation of from 1 to about 4; from about 10% to about 25% by weight of compounds having a degree of ethoxylation of from about 4 to about 8; and from about 0.1% to about 15% by weight of compounds having a degree of ethoxylation greater than about 8.

Other suitable anionic surfactants are the water-soluble salts of organic, sulfuric acid reaction products of the general formula $[R_1—SO_3—M]$ where $R_1$ is selected from the group consisting of a straight or branched chain, saturated aliphatic hydrocarbon radical having from about 8 to about 24, preferably about 10 to about 18, carbon atoms; and M is as previously described above in this section. Examples of such surfactants are the salts of an organic sulfuric acid reaction product of a hydrocarbon of the methane series, including iso-, neo-, and n-paraffins, having about 8 to about 24 carbon atoms, preferably about 12 to about 18 carbon atoms and a sulfonating agent, e.g., $SO_3$, $H_2SO_4$, obtained according to known sulfonation methods, including bleaching and hydrolysis.

Still other suitable anionic surfactants are the reaction products of fatty acids esterified with isethionic acid and neutralized with sodium hydroxide where, for example, the fatty acids are derived from coconut or palm oil; or sodium or potassium salts of fatty acid amides of methyl tauride in which the fatty acids, for example, are derived from coconut oil.

Additional suitable anionic surfactants are the succinates, examples of which include disodium N-octadecylsulfosuccinate; disodium lauryl sulfosuccinate; diammonium lauryl sulfosuccinate; tetra sodium N-(1,2-dicarboxyethyl)-N-octadecylsulfosuccinate; the diamyl ester of sodium sulfosuccinic acid; the dihexyl ester of sodium sulfosuccinic acid; and the dioctyl ester of sodium sulfosuccinic acid. Other suitable anionic surfactants are those that are derived from amino acids. Nonlimiting examples of such surfactants include N-acyl-L-glutamate, N-acyl-N-methyl-β-alanate, N-acylsarcosinate, and their salts. As well as surfactants derived from taurine, which is also known as 2-aminoethanesulfonic acid. An example of such an acid is N-acyl-N-methyl taurate.

The adjuvants are particularly useful in thickening difficult-to-thicken branched anionic primary surfactants such as ($C_{14}$–$C_{16}$) alpha olefin sulfonates and secondary ($C_{14}$–$C_{17}$) alkane sulfonates. The adjuvant when used alone often is sufficient to thicken these surfactant systems.

Olefin sulfonates having about 10 to about 24 carbon atoms may also be used and are a preferred primary surfactant of the present invention. The adjuvant compositions of the present invention worked particularly well with alpha olefin sulfonates despite the fact that they are usually difficult to thicken. The term "olefin sulfonates" is used herein to mean compounds which can be produced by the sulfonation of alpha-olefins by means of uncomplexed sulfur trioxide, followed by neutralization of the acid reaction mixture in conditions such that any sulfones which have been formed in the reaction are hydrolyzed to give the corresponding hydroxy-alkanesulfonates. The sulfur trioxide can be liquid or gaseous, and is usually, but not necessarily, diluted by inert diluents, for example by liquid $SO_2$, chlorinated hydrocarbons, etc., when used in the liquid form, or by air, nitrogen, gaseous $SO_2$, etc., when used in the gaseous form. The alpha-olefins from which the olefin, sulfonates are derived are mono-olefins having about 12 to about 24 carbon atoms, preferably about 14 to about 16 carbon atoms.

In addition to the true alkene sulfonates and a proportion of hydroxy-alkanesulfonates, the olefin sulfonates can contain minor amounts of other materials, such as alkene disulfonates depending upon the reaction conditions, proportion of reactants, the nature of the starting olefins and impurities in the olefin stock and side reactions during the sulfonation process.

Another class of suitable anionic surfactants are the beta-alkyloxy alkane sulfonates. These compounds have the following formula:

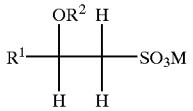

where $R^1$ is a straight chain alkyl group having from about 6 to about 20 carbon atoms, $R^2$ is a lower alkyl group having from about 1 to about 3 carbon atoms, and M is as described above. Frequently used anionic surfactants that are useful for the present invention include ammonium lauryl sulfate, ammonium laureth sulfate, triethylamine lauryl sulfate, triethylamine laureth sulfate, triethanolamine lauryl sulfate, triethanolamine laureth sulfate, monoethanolamine lauryl sulfate, monoethanolamine laureth sulfate, diethanolamine lauryl sulfate, diethanolamine laureth sulfate, lauric monoglyceride sodium sulfate, sodium lauryl sulfate, sodium laureth sulfate, potassium lauryl sulfate, potassium laureth sulfate, sodium lauryl sarcosinate, sodium lauroyl sarcosinate, lauryl sarcosine, cocoyl sarcosine, ammonium cocoyl sulfate, ammonium lauroyl sulfate, sodium cocoyl sulfate, sodium lauroyl sulfate, potassium cocoyl sulfate, potassium lauryl sulfate, triethanolamine lauryl sulfate, triethanolamine lauryl sulfate, monoethanolamine cocoyl sulfate, monoethanolamine lauryl sulfate, sodium tridecyl benzene sulfonate, and sodium dodecyl benzene sulfonate, sodium N-lauroyl-L-glutamate, triethanol N-lauryoyl-L-glutamate, sodium N-lauroyl-N-methyl taurate, sodium N-lauroyl-N-methyl-o-aminopropionate, and mixtures thereof The surfactant systems of the present invention may also include amphoteric and/or zwitterionic surfactants. Amphoteric surfactants include the derivatives of aliphatic secondary and tertiary amines in which the aliphatic radical is straight or branched and one of the aliphatic substituents contains from about 8 to about 18 carbon atoms and one contains an anionic water solubilizing group, e.g., carboxy, sulfonate, sulfate, phosphate, or phosphonate.

Zwitterionic surfactants suitable for use in the shampoo compositions include the derivatives of aliphatic quaternary ammonium, phosphonium, and sulfonium compounds, in which the aliphatic radicals are straight or branched, and wherein one of the aliphatic substituents contains from about 8 to about 18 carbon atoms and one contains an anionic group, e.g., carboxy, sulfonate, sulfate, phosphate, or phosphonate. A general formula for these compounds is:

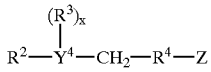

where $R^2$ contains an alkyl, alkenyl, or hydroxy alkyl radical of from about 8 to about 18 carbon atoms, from 0 to about 10 ethylene oxide moieties and from 0 to about 1 glyceryl moiety; Y is selected from the group consisting of nitrogen, phosphorus, and sulfur atoms; $R^3$ is an alkyl or monohydroxyalkyl group containing 1 to about 3 carbon atoms; X is 1 when Y is a sulfur atom, and 2 when Y is a nitrogen or phosphorus atom; $R^4$ is an alkylene or hydroxyalkylene of from 1 to about 4 carbon atoms and Z is a radical selected from the group consisting of carboxylate, sulfonate, sulfate, phosphonate, and phosphate groups.

Examples of amphoteric and zwitterionic surfactants also include sultaines and amidosultaines. Sultaines, including amidosultaines, include for example, cocodimethylpropylsultaine, stearyldimethylpropylsultaine, lauryl-bis-(2-hydroxyethyl) propylsultaine and the like; and the amidosultaines such as cocamidodimethylpropylsultaine, stearylamidododimethylpropylsultaine, laurylamidobis-(2-hydroxyethyl) propylsultaine, and the like. Preferred are amidohydroxysultaines such as the $C_{12}$–$C_{18}$ hydrocarbyl amidopropyl hydroxysultaines, especially $C_{12}$–$C_{14}$ hydrocarbyl amido propyl hydroxysultaines, e.g., laurylamidopropyl hydroxysultaine and cocamidopropyl hydroxysultaine.

Other suitable amphoteric surfactants are the aminoalkanoates of the formula $R—NH(CH_2)_nCOOM$, the iminodialkanoates of the formula $R—N[(CH_2)_mCOOM]_2$ and mixtures thereof; wherein n and m are numbers from 1 to about 4, R is $C_8$–$C_{22}$ alkyl or alkenyl, and M is hydrogen, alkali metal, alkaline earth metal, ammonium or alkanolammonium.

Examples of suitable aminoalkanoates include n-alkylamino-propionates and n-alkyliminodipropionates, specific examples of which include N-lauryl-beta-amino propionic acid or salts thereof, and N-lauryl-beta-imino-dipropionic acid or salts thereof, and mixtures thereof.

Other suitable amphoteric surfactants include those represented by the formula:

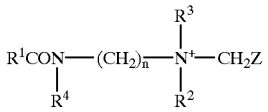

where $R^1$ is $C_8$–$C_{22}$ alkyl or alkenyl, preferably $C_{12}$–$C_{16}$, $R^2$ and $R^3$ is independently selected from the group consisting of hydrogen, $CH_2CO_2M$, $CH_2CH_2OH$, $CH_2CH_2OCH_2CH_2COOM$, or $(CH_2CH_2O)_mH$ wherein m is an integer from 1 to about 25, and $R^4$ is hydrogen, $CH_2CH_2OH$, or $CH_2CH_2OCH_2CH_2COOM$, Z is $CO_2M$ or $CH_2CO_2M$, n is 2 or 3, preferably 2, M is hydrogen or a cation, such as alkali metal (e.g., lithium, sodium, potassium), alkaline earth metal (beryllium, magnesium, calcium, strontium, barium), or ammonium. This type of surfactant is sometimes classified as an imidazoline-type amphoteric surfactant, although it should be recognized that it does not necessarily have to be derived, directly or indirectly, through an imidazoline intermediate. Suitable materials of this type are understood to comprise a complex mixture of species, and can exist in protonated and non-protonated species depending upon pH with respect to species that can have a hydrogen at $R^2$. All such variations and species are meant to be encompassed by the above formula.

Examples of surfactants of the above formula are monocarboxylates and dicarboxylates. Examples of these materials include cocoamphocarboxypropionate, cocoamphocarboxypropionic acid, cocoamphocarboxyglycinate (alternately referred to as cocoamphodiacetate), and cocoamphoacetate.

Commercial amphoteric surfactants include those sold under the trade names MIRANOL C2M CONC. N.P., MIRANOL C2M CONC. O.P., MIRANOL C2M SF, MIRANOL CM SPECIAL (Miranol, Inc.); AILKATERIC 2CIB (Alkaril Chemicals); AMPHOTERGE W-2 (Lonza, Inc.); MONATERIC CDX-38, MONATERIC CSH-32 (Mona Industries); REWOTERIC AM-2C (Rewo Chemical Group); and SCHERCOTERIC MS-2 (Scher Chemicals).

Betaine surfactants, i.e. zwitterionic surfactants, are those represented by the formula:

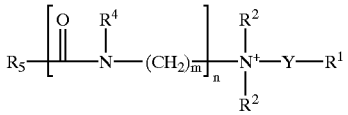

wherein:

$R^1$ is a member selected from the group consisting of

COOM and $CH—CH_2SO_3M$ $R^2$ is lower alkyl or hydroxyalkyl; $R_3$ is lower alkyl or hydroxyalkyl; $R^4$ is a member selected from the group consisting of hydrogen and lower alkyl; $R^5$ is higher alkyl or alkenyl; Y is lower alkyl, preferably methyl; m is an integer from 2 to 7, preferably from 2 to 3; n is the integer 1 or 0.

M is hydrogen or a cation, as previously described, such as an alkali metal, alkaline earth metal, or ammonium.

The term "lower alkyl" or "hydroxyalkyl" means straight or branch chained, saturated, aliphatic hydrocarbon radicals and substituted hydrocarbon radicals having from one to about three carbon atoms such as, for example, methyl, ethyl, propyl, isopropyl, hydroxypropyl, hydroxyethyl, and the like. The term "higher alkyl or alkenyl" means straight or branch chained saturated (i.e., "higher alkyl") and unsaturated (i.e., "higher alkenyl") aliphatic hydrocarbon radicals having from about eight to about 20 carbon atoms such as, for example, lauryl, cetyl, stearyl, oleyl, and the like. It should be understood that the term "higher alkyl or alkenyl" includes mixtures of radicals which may contain one or more intermediate linkages such as ether or polyether linkages or non-functional substitutents such as hydroxyl or halogen radicals wherein the radical remains of hydrophobic character.

Examples of useful surfactant betaines of the above formula wherein n is zero include the alkylbetaines such as cocodimethylcarboxymethylbetaine, lauryldimethylcarboxymethylbetaine, lauryl dimethyl-alpha-carboxyethylbetaine, cetyldimethyl-carboxymethylbetaine, lauryl-bis-(2-hydroxyethyl) carboxymethylbetaine, stearyl-bis-(2-hydroxypropyl) carboxymethylbetaine, oleyldimethyl-gamma-carboxypropylbetaine, lauryl-bis-(2-hydroxypropyl)alpha-carboxyethylbetaine, etc. The sulfobetaines may be represented by cocodimethylsulfopropylbetaine, stearyldimethylsulfopropylbetaine, lauryl-bis-(2-hydroxyethyl)sulfopropylbetaine, and the like.

Specific examples of useful amido betaines and amidosulfo betaines include the amidocarboxybetaines, such as cocamidopropyl betaine, cocamidodimethylcarboxymethylbetaine, laurylamidodimethylcarboxymethylbetaine, cetylamidodimethylcarboxymethylbetaine, laurylamido-bis-(2-hydroxyethyl)-carboxymethylbetaine, cocamido-bis-(2-hydroxyethyl)-carboxymethylbetaine, etc. The amido sulfobetaines may be represented by cocamidodimethylsulfopropylbetaine, stearylamidodimethylsulfopropylbetaine, laurylamido-bis-(2-hydroxyethyl)-sulfopropylbetaine, and the like.

The surfactant systems of the present invention can comprise a nonionic surfactant, suitable examples of which include those compounds produced by condensation of alkylene oxide groups, hydrophilic in nature, with an organic hydrophobic compound, which may be aliphatic or alkyl aromatic in nature. The nonionic surfactants include, but are not limited to (1) polyethylene oxide condensates of alkyl phenols, e.g., the condensation products of alkyl phenols having an alkyl group containing from about 6 to about 20 carbon atoms in either a straight chain or branched chain configuration, with ethylene oxide, the said ethylene oxide being present in amounts equal to from about 10 to about 60 moles of ethylene oxide per mole of alkyl phenol;

(2) those derived from the condensation of ethylene oxide with the product resulting from the reaction of propylene oxide and ethylene diamine products;

(3) long chain tertiary amine oxides of the formula $[R_1R_2R_3N\rightarrow O]$ where $R_1$ contains an alkyl, alkenyl or monohydroxy alkyl radical of from about 8 to about 18 carbon atoms, from 0 to about 10 ethylene oxide moieties, and from 0 to about 1 glyceryl moiety, and $R_2$ and $R_3$ contain from about 1 to about 3 carbon atoms and from 0 to about 1 hydroxy group, e.g., methyl, ethyl, propyl, hydroxyethyl, or hydroxypropyl radicals;

(4) long chain tertiary phosphine oxides of the formula [RR'R"P→] where R contains an alkyl, alkenyl or monohydroxyalkyl radical ranging from about 8 to about 18 carbon atoms in chain length, from 0 to about 10 ethylene oxide moieties and from 0 to 1 glyceryl moieties and R' and R" are each alkyl or monohydroxyalkyl groups containing from about 1 to about 3 carbon atoms;

(5) long chain dialkyl sulfoxides containing one short chain alkyl or hydroxy alkyl radical of from 1 to about 3 carbon atoms (usually methyl) and one long hydrophobic chain which include alkyl, alkenyl, hydroxy alkyl, or keto alkyl radicals containing from about 8 to about 20 carbon atoms, from 0 to about 10 ethylene oxide moieties and from 0 to 1 glyceryl moieties; and (6) alkyl polysaccharide (APS) surfactants (e.g. alkyl polyglycosides) having a hydrophobic group with about 6 to about 30 carbon atoms and a polysaccharide (e.g., polyglycoside) as the hydrophilic group; optionally, there can be a polyalkylene-oxide group joining the hydrophobic and hydrophilic moieties; and the alkyl group (i.e., the hydrophobic moiety) can be saturated or unsaturated, branched or unbranched, and unsubstituted or substituted (e.g., with hydroxy or cyclic rings).

(7) The select ethoxylated fatty alcohols having an ethylene oxide moiety corresponding to the formula $(OCH_2CH_2)_n$, wherein n is from about 5 to about 150, preferably from about 6 to about 31, and more preferably from about 7 to about 21 moles of ethoxylation. Moreover, the ethoxylated fatty alcohols useful herein are those having a fatty alcohol moiety having from about 6 to about 30 carbon atoms, preferably from about 8 to about 22 carbon atoms, and more preferably from about 10 to about 19 carbon atoms. These fatty alcohols can be straight or branched chain alcohols and can be saturated or unsaturated.

Nonlimiting examples of suitable ethoxylated fatty alcohols for use in cleansing compositions include ethoxylated fatty alcohols derived from coconut fatty alcohols, the ceteth series of compounds such as ceteth-5 through ceteth-45, which are ethylene glycol ethers of cetyl alcohol, wherein the numeric designation indicates the number of ethylene oxide moieties present; the steareth series of compounds such as steareth-5 through steareth-100, which are ethylene glycol ethers of steareth alcohol, wherein the numeric designation indicates the number of ethylene oxide moieties present; the laureth series of compounds such as laureth-5 through laureth-40, which are ethylene glycol ethers of lauryl alcohol, wherein the numeric designation indicates the number of ethylene oxide moieties present; ceteareth 5 through ceteareth-50, which are the ethylene glycol ethers of ceteareth alcohol, i.e. a mixture of fatty alcohols containing predominantly cetyl and stearyl alcohol, wherein the numeric designation indicates the number of ethylene oxide moieties present; $C_6$–$C_{30}$ alkyl ethers of the ceteth, steareth, and ceteareth compounds just described; the pareth series of compounds such as pareth-5 through pareth-40, which are ethylene glycol ethers of synthetic fatty alcohols containing both even- and odd-carbon chain length fractions, wherein the numeric designation indicates the number of ethylene oxide moieties present; and mixtures thereof. Specific examples of ethoxylated fatty alcohols are those selected from the group consisting of ceteth-10, ceteth-20, steareth-10, steareth-20, steareth-21, steareth-100, laureth-12, laureth-23, ceteareth-20, C12-13 pareth-7, C12-9, C14-15 pareth-13, and mixtures thereof.

(8) Alkoxylated alkanolamides such as $PPG_2$ hydroxyethyl cocamide (Promidium CO, available from Uniqema), $PPG_1$, hydroxyethyl caprylamide (Promidium CC, available from Uniqema), and $PPG_3$ hydroxyethyl soyamide (Promidium SY, available from Uniqema).

Frequently used surfactants include, but are not limited to amine oxides, polyhydroxy fatty acid amides, ethoxylated alkyl sulfates, alkyl ethoxylates, alkyl sulfates, alkylbenzene sulfonates, alkyl ether carboxylates, alkyl glycosides, methyl glucose esters, and betaines, such as sodium lauryl sulfate, sodium laureth sulfate, ammonium lauryl sulfate, ammonium lauryl ether sulfate, secondary $C_{14-17}$ alkane sulfonates (SAS), 2-($C_{14}$–$C_{16}$) alkene sulfonate, 3-($C_{14}$–$C_{16}$) hydroxy ($C_{14}$–$C_{16}$) alkene sulfonate, 4-hydroxyalkene sulfonate, cocoamidopropyl betaine, and combinations thereof. Typically, the primary surfactant, or primary surfactant combination is in the range of about 5% to about 20% by weight of the surfactant system.

A second surfactant may be addled directly to the adjuvant to additionally modify the rheological profile of the surfactant system, for example, aesthetic properties. Desirably, the second surfactant is an alkoxylated alkanolamide such as $PPG_n$ hydroxyethyl cocamide, $PPG_n$ hydroxyethyl caprylamide, and $PPG_n$ hydroxyethyl soyamide, and combinations thereof, wherein n is between about 1–5. $PPG_2$ hydroxyethyl cocamide and $PPG_1$ hydroxyethyl caprylamide are preferred. For the second surfactant to be substantially a liquid is also desirable. However, alkoxylated hydroxyalkyl isostearamide may be used as a solublizer to allow incorporation of a second surfactant that is not substantially a liquid at room temperature without an additional heating step. The ratio of the alkoxylated hydroxyethyl isostearamide to the second surfactant may vary depending on the desired properties. Desirably, about 10% to about 95% of PPG hydroxyethyl isostearamide, and about 5% to about 90% of the second surfactant. A more desired ratio of the isostearamide composition to the second surfactant may be 1:1 to about 1:3 depending on the primary surfactant.

The method of thickening a surfactant composition, which includes at least one primary surfactant, includes adding an alkoxyllated hydroxyalkyl isostearamide adjuvant composition to a surfactant system. The alkoxylated hydroxyalkyl isostearamide composition optionally may include another surfactant. The isostearamide composition may be added without a heating step and without requiring the addition of monoethanolamines, diethanolamines, or diethanolamides. A fragrance may be added to the isostearamide composition prior to its addition to the surfactant system.

A method of thickening a surfactant system may also include the addition of a salt. Useful salts include sodium chloride, potassium chloride, citric acid salts, and other salts known in the art which contribute to electrolytic thickening. Desirably, the salt may be added in a range from about 0.1% to about 5% by weight of the surfactant system, depending on the primary surfactant used.

The surfactant systems of the present invention may be used in a variety of cleansing compositions as well as cosmetic and personal care compositions or any system, particularly those containing surfactants, that requires thickening or adding viscosity. These compositions may include, without limitation, hair care products, such as shampoos, conditioners, gels and hair coloring, industrial cleaners, household cleaners, facial and body washes, liquid hand cleansers, as well as skin care products, such as moisturizers, lotions, sunscreens, and make-up, pre-moistened towels such as those for baby wipes, geriatric wipes and hand wipes among others.

Other materials and ingredients known in the art to be incorporated into cleansing compositions such as other surfactants, coloring and fragrances, among others, may be added to the compositions of the present invention as desired. Examples of such materials are listed below which may include polyalkylene glycols, suspending agents, and other materials.

The surfactant composition may further include a polyalkylene glycol which is known to improve lather performance. The optional polyalkylene glycols are characterized by the general formula:

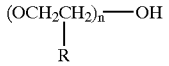

wherein R is selected from the group consisting of H, methyl, and mixtures thereof. When R is H, these materials are polymers of ethylene oxide, which are also known as polyethylene oxides, polyoxyethylenes, and polyethylene glycols. When R is methyl, these materials are polymers of propylene oxide, which are also known as polypropylene oxides, polyoxypropylenes, and polypropylene glycols. When R is methyl, it is also understood that various positional isomers of the resulting polymers can exist.

In the above structure, n has an average value of from about 1500 to about 25,000, preferably from about 2500 to about 20,000, and more preferably from about 3500 to about 15,000. Useful polymers include polypropylene glycol, polyethylene glycol and combinations thereof.

The compositions of the present invention may further comprise a suspending agent at concentrations effective for suspending a silicone conditioning agent, or other water-insoluble material, in dispersed form in the compositions.

Optional suspending agents include crystalline suspending agents which can be categorized as acyl derivatives, long chain amine oxides, and mixtures thereof These suspending agents include ethylene glycol esters of fatty acids preferably having from about 16 to about 22 carbon atoms.

Also included are the ethylene glycol stearates, both mono and distearate, but particularly the distearate containing less than about 7% of the mono stearate. Other suitable suspending agents include alkanol amides of fatty acids, preferably having from about 16 to about 22 carbon atoms, more preferably about 16 to 18 carbon atoms, examples of which include stearic monoethanolamide, stearic monoisopropanolamide and stearic monoethanolamide stearate. Other long chain acyl derivatives include long chain esters of long chain fatty acids (e.g., stearyl stearate, cetyl palmitate, etc.); glyceryl esters (e.g., glyceryl distearate) and long chain esters of long chain alkanol amides (e.g., stearamide monoethanolamide stearate). Long chain acyl derivatives, ethylene glycol esters of long chain carboxylic acids, long chain amine oxides, and alkanol amides of long chain carboxylic acids in addition to the preferred materials listed above may be used as suspending agents. For example, it is contemplated that suspending agents with long chain hydrocarbyls having $C_8$–$C_{22}$ chains may be used.

Examples of suitable long chain amine oxides for use as suspending agents include alkyl ($C_{16}$–$C_{22}$) dimethyl amine oxides, e.g., stearyl dimethyl amine oxide.

Other suitable suspending agents include xanthan gum at concentrations ranging from about 0.3% to about 3%, preferably from about 0.4% to about 1.2%, by weight of the surfactant compositions. Combinations of long chain acyl derivatives and xanthan gum may also be used as a suspending agent.

Other suitable suspending agents include carboxyvinyl polymers. Examples of these are polymers are the copolymers of acrylic acid crosslinked with polyallylsucrose such as Carbopol 934, 940, 941, and 956, available from B.F. Goodrich Company.

Other suitable suspending agents include primary amines having a fatty alkyl moiety having at least about 16 carbon atoms, examples of which include palmitamine or stearamine, and secondary amines having two fatty alkyl moieties each having at least about 12 carbon atoms, examples of which include dipalmitoylamine or di(hydrogenated tallow)amine. Still other suitable suspending agents include di(hydrogenated tallow)phthalic acid amide, and crosslinked maleic anhydride-methyl vinyl ether copolymer.

Additional suitable suspending agents include those that can impart a gel-like viscosity to the composition, such as water soluble or colloidally water soluble polymers like cellulose ethers (e.g., methylcellulose, hydroxybutyl methylcellulose, hyroxypropylcellulose, hydroxypropyl methylcellulose, hydroxyethyl ethylcellulose and hydroxyethylcellulose), guar gum, polyvinyl alcohol, polyvinyl pyrrolidone, hydroxypropyl guar gum, starch and starch derivatives, and other thickeners, viscosity modifiers, gelling agents, etc. Combinations of these materials can also be used.

Other suitable optional materials of the present invention include, but are not limited to, preservatives such as benzyl alcohol, benzoic acid, methyl paraben, propyl paraben, imidazolidinyl urea, iodopropynyl butyl carbamate, methylisothiazolinone, methylchloroisothiazolinone; salts and electrolytes such as sodium chloride, potassium chloride, and sodium sulfate; ammonium xylene sulfonate; propylene glycol; polyvinyl alcohol; ethyl alcohol; pH adjusting agents such as citric acid, succinic acid, phosphoric acid, sodium hydroxide, and sodium carbonate; fragrances and colorings to modify the aesthetic appeal of the composition; hydrogen peroxide; sunscreening agents; hair coloring agents; humectants such as glycerol and other polyhydric alcohols; moisturizers; humectants; antioxidants; and chelating agents such as EDTA; anti-inflammatory agents; steroids; topical anesthetics; and scalp sensates such as menthol.

Cationic conditioning ingredients are well known to those skilled in the art and may also be used as option ingredients. Preferred ingredients of this class are available from Uniqema under the names Phospholipid EFA, Phospholipid SV, Phospholipid PTC, Phospholipid CDM and Phospholipid GLA (all available from Uniqema, a member of the ICI Group).

Synthetic esters may also be used. Antidandruff agents may also be used in the shampoo compositions of the present invention. These agents include particulate antidandruff agents such as pyridinethione salts, selenium compounds such as selenium disulfide, and soluble antidandruff agents.

The features and advantages of the present invention are more fully shown by the following examples which are provided for purposes of illustration, and are not to be construed as limiting the invention in any way.

EXAMPLES

Examples 1–4 demonstrate a comparison of the viscosity building performance of compositions of the present invention with monoethanolamide compositions and other alkoxylated alkanolamides, by weight % on an active basis.

Example 1

Surfactant systems were prepared including 17% by weight sodium laureth-2 sulfate (SLES-2) and 3% by weight of a variety of surfactant compositions A–D, as set forth below, at pH 6.5. The viscosities of the surfactant systems were tested at different salt (sodium chloride) concentrations as shown in TABLE I.

TABLE I

| | Viscosity (cps) | | | |
|---|---|---|---|---|
| % SALT | A | B | C | D |
| 0 | 220 | 140 | 500 | 125 |
| 1 | 3900 | 17000 | 7000 | 3650 |
| 2 | 5700 | 92000 | 29000 | 14800 |
| 3 | 90000 | 3000 | 34000 | 18300 |
| 4 | 120000 | | 15500 | 8000 |
| 5 | 200 | | | |

Compositions A–D are as follows:
A) $PPG_1$ hydroxyethyl isostearamide
B) cocomonoethanol amide (CMA)
C) $PPG_3$ hydroxyethyl soyamide
D) $PPG_2$ hydroxyethyl cocamide Inventive Composition A, $PPG_1$ hydroxyethyl isostearamide clearly and surprisingly outperformed Comparative Composition B, cocomonoethanol amide (CMA), which is a monoethanolamide known to enhance viscosity building, but because it is not a liquid at room temperature, requires an additional heating step to incorporate it into a surfactant system. The isostearamide performance also far exceeded that of Comparative Compositions C and D the soyamide and the cocamide compositions, respectively.

Example 2

Surfactant systems were prepared including 7%, alpha olefin sulfonate (AOS) (which generally include 70% 2-($C_{14}$–$C_{16}$) alkene sulfonate and 30% 3-(or 4) hydroxy ($C_{14}$–$C_{16}$) alkane sulfonate), 3% cocoamidopropyl betaine (CAB) and 2.5% by weight of a variety of surfactant compositions A–E, as set forth below. The viscosities of the surfactant systems were tested at different salt (sodium chloride) concentrations as shown in TABLE II.

TABLE II

| | Viscosity (cps) | | | | |
|---|---|---|---|---|---|
| % SALT | A | B | C | D | E |
| 0 | 1800 | 40 | 40 | 5 | 5 |
| 0.25 | 2000 | 60 | 70 | 10 | 20 |
| 0.50 | 4399 | 70 | 180 | 40 | 50 |
| 0.75 | 20,596 | 80 | 700 | 160 | 180 |
| 1.00 | 24,195 | 180 | 1700 | 1500 | 900 |
| 1.25 | 3999 | 800 | 2999 | 3099 | 2399 |
| 1.50 | 1300 | 1200 | 5599 | 4599 | 4499 |

Compositions A–E are as follows:
A) $PPG_{1.5}$ hydroxyethyl isostearamide
B) $PPG_2$ hydroxyethyl cocamide
C) blend of 25% $PPG_{1.5}$ hydroxyethyl isostearamide/75% $PPG_2$ hydroxyethyl cocamide
D) Cocamide DEA
E) $PPG_3$ hydroxyethyl soyamide Alpha olefin sulfate (AOS) surfactant systems are relatively difficult to thicken. Inventive Composition A, the isostearamide composition, was alone found to work very well with AOS, and far exceeded the viscosity building performance of the other compositions. Inventive Composition C, the blended composition of the isostearamide and cocamide also outperformed Comparative Composition B, the cocamide alone. Similar results were found for these surfactant compositions when included in surfactant systems that included secondary $C_{14-17}$ alkane sulfonates (SAS), which are also difficult to thicken.

Example 3

Surfactant systems were prepared that included 7% by weight sodium lauryl ether sulfate, 3% cocoamidopropyl betaine, and 2.5% by weight of surfactant compositions A–E as set forth below. The viscosities of these surfactant systems were tested at different salt (sodium chloride) concentrations as shown in TABLE III.

TABLE III

| | Viscosity (cps) | | | |
|---|---|---|---|---|
| % SALT | A | B | C | D |
| 0 | 260 | 2999 | 120 | 1500 |
| 0.25 | 1800 | 15,597 | 600 | 9098 |
| 0.50 | 3799 | 25,095 | 3599 | 19,996 |
| 0.75 | 7598 | 32,093 | 6399 | 29,394 |
| 1.00 | 13,197 | 32,393 | 11,698 | 31,993 |
| 1.25 | 16,297 | 23,495 | 17,596 | 30,993 |
| 1.50 | 17,897 | 9398 | 22,295 | 14,697 |

Compositions A–D are as follows:
A) $PPG_2$ hydroxyethyl cocamide
B) blend of 25% $PPG_{1.5}$ hydroxyethyl isostearamide/75% $PPG_2$ hydroxyethyl cocamide
C) Cocamide DEA
D) $PPG_3$ hydroxyethyl soyamide Inventive Composition B, the blend of the isostearamide composition with the cocamide composition clearly outperformed in viscosity building properties Comparative Compositions A, C and D.

In addition to the viscosity building performance of the isostearamide compositions and blends thereof, the isostearamide compositions were found to have excellent color stability. After one month at 60° C., the isostearamide systems maintained Gardner 1 color.

Example IV

Surfactant systems were prepared using 7% by weight ammonium lauryl ether sulfate (ALES), 3% ammonium lauryl sulfate, And 2.5% of surfactant compositions A–E as set forth below. The viscosities of these surfactant systems were tested at different salt (sodium chloride) concentrations as shown in Table IV.

TABLE IV

| | Viscosity (cps) | | | | |
|---|---|---|---|---|---|
| % SALT | A | B | C | D | E |
| 0 | 560 | 10 | 20 | 10 | 5 |
| 0.25 | 700 | 20 | 30 | 20 | 10 |
| 0.50 | 1900 | 30 | 80 | 40 | 20 |
| 0.75 | 4499 | 80 | 220 | 540 | 180 |
| 1.00 | 6699 | 360 | 2699 | 1300 | 1400 |
| 1.25 | 5899 | 1400 | 4299 | 1500 | 2200 |
| 1.50 | 1300 | 1900 | 5499 | 3399 | 3399 |

Compositions A–E are as follows:
A) $PPG_{1.5}$ hydroxyethyl isostearamide
B) $PPG_2$ hydroxyethyl cocamide
C) blend of 25% $PPG_{1.5}$ hydroxyethyl isostearamide/75% $PPG_2$ hydroxyethyl cocamide
D) Cocamide DEA
E) $PPG_3$ hydroxyethyl soyamide Table IV also demonstrates the superior viscosity building capability of inventive composition A, the isostearamide. Both inventive compositions A and B outperformed in viscosity building properties the Cocamide DEA, comparative composition D.

Example V

Example 5 relates to a surfactant system that is difficult to thicken and difficult to keep clear at low temperatures.

Compositions including AOS were prepared as described below and tested for viscosity and Krafft point at different salt (sodium chloride) concentrations.

TABLE V

| | Viscosity (cps) | | | |
|---|---|---|---|---|
| % SALT | A | B | C | D |
| 0 | 10* | 16* | 20* | 26* |
| 1 | 25 | 26* | 90* | 118* |
| 2 | 30 | 62* | 2,400* | 3,430* |
| 3 | 35 | 334 | 16,000* | 12,600* |
| 4 | 65 | 1188 | 153,000* | 1,680* |
| 5 | 450 | | | |

*indicates a Krafft point at about 10° C. or below.
Compositions A–D are as follows:
A) 20% active AOS (control)
B) 16% active AOS and 4% active $PPG_2$ hydroxyethyl cocamide
C) 16% active AOS and 4% active cocamide MEA
D) 16% active AOS and 4% active $PPG_{1.5}$ hydroxyethyl isostearamide Inventive Composition D, the isostearamide outperformed comparative compositions A and B and performed well against Comparative Composition C, without requiring heating, as in the cocamide MEA.

Example 6

The following is an example of a cleaning composition in accordance with the present invention:

TABLE 6

| COMPONENT | WEIGHT % |
|---|---|
| A Water | q.s. to 100% |
| B Salt (sodium chloride) | 0.50 |
| C Disodium EDTA | 0.20 |
| D ALES | 6.72 |
| E ALS | 2.50 |
| F Potassium $C_{12-13}$ Alkyl Phosphate | 1.20 |
| G Linoleamidopropyl PG-Diammonium | 0.60 |
| H Bead Suspending Agent | 0.14 |
| I $PPG_2$ hydroxyethyl cocamide | 1.50 |
| J $PPG_{1.5}$ hydroxyethyl isostearamide | 0.50 |
| K Jojoba beads | 0.70 |
| L DMDM hydantoin | 0.50 |
| M Fragrance | 0.10 |

The ingredients of Table VI were combined to produce a body wash composition by the following steps:

1) Components A–C were mixed at room temperature until clear.
2) Then components D–G were added with mixing. Component H was then slowly added with mixing until the entire composition was clear.
3) Components I–M were then blended separately at room temperature.
4) The component I–M blend was then added to the component A–H combination and the pH was adjusted to about 6.0.

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

What is claimed is:

1. A surfactant system comprising:

a) a primary surfactant composition; and b) an adjuvant composition comprising ($C_2$–$C_4$) alkoxylated mono($C_2$–$C_3$)alkanol isostearamide, wherein the adjuvant composition is substantially a liquid at room temperature and modifies the rheological properties of the surfactant system.

2. The surfactant system of claim 1 wherein the surfactant system is free of any added monoethanolamines, diethanolamines, and diethanolamides.

3. The surfactant system of claim 1 wherein the alkoxylated monoalkanol isostearamide comprises $PPG_n$ hydroxyethyl isostearamide wherein n is from 1 to 4.

4. The surfactant system of claim 1 wherein the primary surfactant composition is a member selected from the group consisting of amide oxides, lauryl sulfate and its cationic salts, laureth sulfate and its cationic salts, 2-($C_{14}$–$C_{16}$) alkene sulfonate and its cationic salts, 3-hydroxy ($C_{14}$–$C_{16}$) alkene sulfonate and its cationic salts, 4-hydroxy ($C_{14}$–$C_{16}$) alkene sulfonate, cocoamidopropyl betaine, amine oxides, secondary ($C_{14}$–$C_{17}$) alkane sulfonates and combinations thereof.

5. The surfactant system of claim 1 wherein the adjuvant composition further comprises a second surfactant, different than said isostearamide.

6. The surfactant system of claim 5 wherein the adjuvant composition further comprises a second surfactant comprises an alkoxylated alkanolamide different than the isostearamide.

7. The surfactant system of claim 6 the second surfactant is selected from the group consisting of polypropylene glycol hydroxyethyl caprylamide, polypropylene glycol hydroxyethyl cocamide, and combinations thereof.

8. The surfactant system of claim 5 wherein the ratio of isostearamide to the second surfactant is from about 1:1 to about 1:3.

9. The surfactant system of claim 7 wherein the ratio of isostearamide to the second surfactant is about 1:3.

10. The surfactant system of claim 1 further comprising a salt.

11. An adjuvant composition for modifying the rheological properties of a surfactant system, wherein the composition is substantially liquid at room temperature and comprises a surfactant adjuvant comprising ($C_2$–$C_4$) alkoxylated hydroxy ($C_2$–$C_3$) alkyl isostearamide and a second surfactant different than the adjuvant.

12. The composition of claim 11 wherein the adjuvant is $PPG_n$ hydroxyethyl isostearamide wherein n is a number from 1 to 4.

13. The surfactant composition of claim 11 wherein the second surfactant comprises an alkoxylated alkanolamide.

14. The surfactant composition of claim 12 wherein the second surfactant is selected from the group consisting of polypropylene glycol hydroxyethyl caprylamide, polypropylene glycol hydroxyethyl cocamide, and combinations thereof.

15. The surfactant composition of claim 11 wherein the isostearamide is $PPG_n$ hydroxyethyl isostearamide and comprises at least about 10% by weight of the composition wherein n is from 1 to 2.

16. The surfactant composition of claim 11 wherein the isostearamide comprises at least about 25% by weight of the composition.

17. A method of thickening a surfactant system comprising at least one primary surfactant, the method comprising the step of adding to the surfactant system an adjuvant composition comprising ($C_2$–$C_4$) alkoxylated hydroxyethyl isostearamide which is substantially a liquid at room temperature.

18. The method of claim 17 wherein the adjuvant composition comprises polypropylene glycol hydroxyethyl isostearamide which was alkoxylated with at least about one mole of polypropylene glycol.

19. The method of claim 17 wherein the surfactant system is free of any added monoethanolamides, diethanolamines and diethanolamides.

20. The method of claim 17 wherein the surfactant system comprises a primary surfactant composition selected from the group consisting of amine oxides, lauryl sulfate and its cationic salts, laureth sulfate and its cationic salts, 2-($C_{14}$–$C_{16}$) alkene sulfonate and its cationic salts, 3-hydroxy ($C_{14}$–$C_{16}$) alkene sulfonate and its cationic salts, 4-hydroxy ($C_{14}$–$C_{16}$) alkene sulfonate and its cationic salts, cocoamidopropyl betaine, amine oxides, secondary alkane sulfonates, and combinations thereof.

21. The method of claim 17 further comprising the step of adding a salt to the surfactant system.

22. A method of thickening a surfactant system comprising at least one primary surfactant, the method comprising the step of adding to the surfactant system a composition comprising polypropylene glycol hydroxyethyl isostearamide and a second surfactant.

23. The method of claim 22 wherein the polypropylene glycol hydroxyethyl isostearamide comprises from about one to four moles of polypropylene glycol.

24. The method of claim 22 wherein the surfactant system is free of any added monoethanolamines, diethanolamines, and diethanolamides.

25. The method of claim 22 wherein the surfactant system comprises a primary surfactant composition selected from the group consisting of amine oxides, sodium lauryl sulfate, sodium laureth sulfate, ammonium lauryl sulfate, ammonium lauryl ether sulfate, 2-($C_{14}$–$C_{16}$) alkene sulfonate, 3-hydroxy ($C_{14}$–$C_{16}$) alkene sulfonate, 4-hydroxyalkene sulfonate, cocoamidopropyl betaine, and combinations thereof.

26. The method of claim 22 wherein the second surfactant comprises an alkanolamide.

27. The method of claim 26 wherein the second surfactant is selected from the group consisting of polypropylene glycol hydroxyethyl caprylamide, polypropylene glycol hydroxyethyl cocamide, and combinations thereof.

28. A surfactant system free of any added monoethanolamines, diethanolamines, and diethanoamides comprising the reaction product of a) a primary surfactant composition; and b) an adjuvant composition comprising alkoxylated hydroxyalkyl isostearamide, which is substantially liquid at room temperature and modifies the rheological properties of said surfactant system.

29. The surfactant system of claim 28 wherein the alkoxylated hydroxyalkyl isostearamide comprises polyalkylene glycol hydroxyethyl isostearamide having at least about one mole of polypropylene glycol.

30. The surfactant system of claim 28 further comprising a second surfactant, to modify rheological properties, different than the isostearamide.

31. A cleansing composition comprising:

a) a detersive composition selected from the group consisting of sodium lauryl sulfate, sodium lureth sulfate, ammonium lauryl sulfate, ammonium lauryl ether sulfate, sodium 2-($C_{14}$–$C_{16}$) alkene sulfonate, sodium 3-hydroxy ($C_{14}$–$C_{16}$) alkene sulfonate, sodium 4-hydroxy ($C_{14}$–$C_{16}$) alkene sulfonate, cocoamidopropyl betaine, and combinations thereof; and b) an adjuvant composition to modify the rheological properties that is free of any added monoethanolamines, diethanolamines and is substantially a liquid at room temperature comprising polypropylene glycol hydroxyethyl isostearamide and a second surfactant different than the isostearamide selected from the group consisting of polypropylene glycol hydroxyethyl caprylamide, polypropylene glycol hydroxyethyl cocamide and combinations thereof.

32. The cleaning composition of claim 31 wherein the cleaning composition is a shampoo.

33. The cleaning composition of claim 31 wherein the cleaning composition is an industrial cleaner.

34. The cleaning composition of claim 31 wherein the cleaning composition is a household cleaner.

35. The cleaning composition of claim 31 wherein the cleaning composition is a liquid hand cleanser.

36. The cleaning composition of claim 27 wherein the cleaning composition is a facial or body wash.

37. A surfactant system free of any added monoethanolamines, diethanolamines and diethanaolamides comprising:

a) a primary surfactant composition; and b) an adjuvant composition comprising polypropylene glycol hydroxyethyl isostearamide, wherein the adjuvant composition is substantially a liquid at room temperature and modifies the rheological properties of said surfactant system.

38. A cleaning composition comprising $PPG_n$ hydroxyethyl isostearamide and a ($C_{14}$–$C_{16}$) alkene sulfonate wherein n is from 1 to 2.

39. The surfactant system of claim 1 wherein the primary surfactant composition is a salt selected from the group consisting of lauryl sulfate, lauryl ether sulfate, 2-($C_{14}$–$C_{16}$) alkene sulfonate, 3-hydroxy ($C_{14}$–$C_{16}$) alkene sulfonate, 4-hydroxy ($C_{14}$–$C_{16}$) alkene sulfonate, cocoamidopropyl betaine, secondary ($C_{14}$–$C_{17}$) alkane sulfonates and combinations thereof; and the adjuvant composition comprises $polypropylene_n$ hydroxethyl isostearamide which is substantially liquid at room temperature wherein n is from 1 to 2.

40. The surfactant system of claim 39 wherein the primary surfactant is selected from the ($C_{14}$–$C_{16}$) alkene sulfonate, 3-hydroxy ($C_{14}$–$C_{16}$) alkene sulfonate, 4-hydroxy ($C_{14}$–$C_{16}$) alkene sulfonate and combinations thereof and the isostearamide adjuvant comprises about 1 to about 25 weight percent of the surfactant system and the surfactant system further comprises water.

41. The surfactant system of claim 39 wherein the salts of lauryl sulfate and lauryl ether sulfonate are selected from the group consisting of ammonium, triethanolammonium, sodium, potassium, magnesium, calcium and combinations thereof; and the surfactant system further comprises water.

42. The surfactant composition of claim 9 wherein the second surfactant is polypropylene glycol hydroxyethyl cocamide.

43. The surfactant system of claim 41 comprising a primary surfactant of sodium laureth-2 sulfate, and $PPG_n$ hydroxyethyl isostearamide and $PPG_2$ hydroxyethyl cocamide in a ratio of about 1:3, and water wherein n is from 1 to 2.

44. The surfactant composition of claim 41 comprising ammonium lauryl ether sulfate, and $PPG_n$ hydroxyethyl isostearamide and $PPG_2$ hydroxylethyl cocamide in a ratio of about 1:3, and water wherein n is from 1 to 2.

45. The surfactant composition of claim 41 comprising sodium lauryl ether sulfate and $PPG_n$ hydroxyethyl isostearamide and $PPG_2$ hydroxylethyl cocamide in a ratio of about 1:3 and water wherein n is from 1 to 2.

46. The surfactant system of claim 4 or claim 20 wherein the cation is selected from the group consisting of ammonium, triethanolammonium, sodium, potassium, magnesium, calcium and combinations thereof.

* * * * *

UNITED STATES PATENT AND TRADEMARK OFFICE

CERTIFICATE OF CORRECTION

PATENT NO. : 6,635,607 B2 
DATED : October 21, 2003
INVENTOR(S) : Craig B. Queen and John L. Gormley It is certified that error appears in the above-identified patent and that said Letters Patent is hereby corrected as shown below:

Column 11,
Line 2, delete "[RR'R"P→]" and insert -- [RR'R"P→O] --
Line 66, delete "C12-9" and insert -- C12-15 pareth --9 --

Column 12,
Line 19, delete "addled" and insert -- added --
Line 40, delete "alkoxyllated" and insert -- alkoxylated --

Signed and Sealed this

Fifteenth Day of June, 2004

JON W. DUDAS
*Acting Director of the United States Patent and Trademark Office*